US005983904A

United States Patent [19]

Fung

[11] Patent Number: 5,983,904

[45] Date of Patent: Nov. 16, 1999

[54] HAIR CURLER

[75] Inventor: Kam Fai Fung, Hong Kong, The Hong Kong Special Administrative Region of the People's Republic of China

[73] Assignee: Conair Corporation, Stamford, Conn.

[21] Appl. No.: 09/315,570

[22] Filed: May 20, 1999

[51] Int. Cl.[6] ..... A45D 2/24; A45D 2/26

[52] U.S. Cl. ..... 132/256; 132/254; 132/255; 132/245

[58] Field of Search ..... 132/256, 245, 132/250, 251, 252, 253, 254, 255, 257, 258, 259, 260, 266, 226

[56] References Cited

U.S. PATENT DOCUMENTS

| | | | |
|---|---|---|---|
| Re. 32,349 | 2/1987 | Glucksman . | |
| 3,275,007 | 9/1966 | Thackeray | 132/256 |
| 3,939,851 | 2/1976 | Parlagreco | 132/239 |
| 4,234,000 | 11/1980 | Pizzino | 132/252 |
| 4,382,447 | 5/1983 | Glucksman . | |
| 4,598,722 | 7/1986 | Doyle | 132/226 |
| 4,627,452 | 12/1986 | Caruso | 132/252 |
| 5,076,299 | 12/1991 | Wistrand et al. | 132/253 |

*Primary Examiner*—Gene Mancene
*Assistant Examiner*—Philogene Pedro
*Attorney, Agent, or Firm*—Ohlandt, Greeley, Ruggiero & Perle, L.L.P.

[57] ABSTRACT

A hair roller is provided with an hollow outer member enclosing an inner member. A plurality of hair clips is connected to the inner member by flexible roots and connected to the outer member by integral pivot axes. The hair clips extend though longitudinal openings in the outer member. Longitudinal movement of the inner member relative to the outer member, thereby causes the hair clips to either grip or release a user's hair when the user's hair is wound upon the outer member. Also provided is detent mechanism that allow the inner member to be restricted in gripping and released positions.

10 Claims, 4 Drawing Sheets

HAIR CURLER

FIELD OF THE INVENTION

This invention relates generally to personal care devices for grooming hair. More particularly, the invention relates to hair curlers.

BACKGROUND OF THE ART

Hair curlers generally comprise a hair rolling portion and a closure member for retaining the hair upon the hair rolling portion. The hair rolling portion is usually a generally cylindrical member comprising a core about which the hair is wound and end flanges that bound the core and have a greater diameter than the core. An example is shown in U.S. Pat. No. 4,598,722 issued to Doyle for an Elastomer Hair Roller. The Doyle hair roller includes an hollow outer barrel bound by a pair of end flanges.

Many kinds of clamping attachments, securing devices, and hair tension methods are employed to hold hair on the hair rolling portion of a hair curler. Most often this attachment or device is a piece that is separate from the hair curler, such as a clip or bobby pin that is attached to the curler in a way to retain hair wound thereupon. An example is shown in U.S. Pat. No. 4,234,000 issued to Pizzino for a Compound Hair Roller. The Pizzino compound hair roller has two members suitable for receiving a portion of a length of hair. One member is a hollow cylindrical roller. The other member is a shell-like roller having a longitudinal slot and a plurality of fins projecting radially inward from its interior surface. The shell-like roller is adapted to receive the hollow cylindrical roller upon which hair has been wound so as to hold the hair in place.

Another example of an attachment employed to hold hair on the hair rolling portion of a hair curler is shown in U.S. Pat. No. 4,627,452 issued to Caruso for an Electrically Heated Hair Roller. A perforated shield engages the end pieces of the hair roller so as to envelop a substantial portion of the roller, thereby creating a chamber. The chamber is defined by the outer surface of the hair rolling portion, the end flanges, and the inner surface of the perforated shield. The perforations in the shield permit steam to enter into the chamber. The hair roller is electrically heated internally. To use the hair roller, the shield must be removed, but the shield is re-engaged after hair has been wound onto the hair roller, and, along with helping to retain steam, the shield helps hold the hair around the roller.

Hair curlers with separate closure members are somewhat difficult to use on one's own hair because the user must use her hands to wind the hair on the hair rolling portion, hold the hair there with one hand, while grasping a clip with the other hand, and then maneuver the closure (often without looking) to lock the hair in place. Another disadvantage of separate closure members is that they generally must be made hard and relatively inflexible in order to satisfactorily hold hair. This may make them uncomfortable to wear.

Some hair curlers have a closure member affixed to the hair rolling portion. Such members are really separate pieces that are mechanically hinged or otherwise movably joined with the hair rolling portion. An example is U.S. Pat. No. 3,939,851 issued to Parlagreco for a Single Step Hair Curler With Independent Self-Contained Supporting and Securing Means. This invention pertains to a hair curler having a roller rotatably mounted on end supports whose base portions are adapted to rest on the head of the user. Each end support operates independently of the other and each may include a self-contained securing tension mechanism in the form of a ratchet device. The roller can be easily disengaged from its position on the user's head by tipping the roller over and releasing the tension thereby enabling the user to unwind the hair. Such devices remain uncomfortable on the scalp, awkward to use and, additionally, are costly to manufacture.

Other hair curlers have a pliable closure member integrally attached to the hair rolling portion. An example of a pliable closure is shown in U.S. Pat. No. 5,076,299 issued to Wistrand et al. for a Flexible Locking Hair Curler. The Wistrand hair curler is a spool type hair curler having a cylindrical hair roller portion formed between a pair of opposing parallel flanges and provided with a pliable integrally formed, cup shaped closure member. The closure member is axially aligned with one of the end flanges of the spool shaped hair roller portion. The wall of the cup-shaped closure member extends away from the spool shaped portion and, after the hair is wound upon the spool-shaped portion, the wall may be flipped substantially 180 degrees about its point of attachment in order to place the rim of the cup-shaped closure member proximate to the other flange to thereby retain the hair around the spool shaped portion.

Pliable closures are comfortable on the head and relatively easy to use. Yet pliable, elastomeric materials capable of retaining sufficient heat are heavier than plastic, so the devices are quite uncomfortable because they pull the hair. This effect is especially problematic as the size of the hair curler increases. A balance must be found between a material that is soft enough to be pliable, but strong enough to hold a desired shape without becoming entangled in the user's hair. In addition, elastomeric materials can be so slick as to make it difficult for the user to wind hair around it.

Accordingly, a need exists for a hair curler with a closure to hold hair on a hair rolling member that is comfortable to wear, is easy to use, and is inexpensive to manufacture.

It is an object of this invention to provide a hair curler with a closure to hold hair on a hair rolling member that is comfortable against the head because it does not have jutting edges and it does not press on the head to hold itself in place.

It is a further object of this invention to provide a hair curler with a closure to hold hair on the hair rolling member that is comfortable to wear and does not pull or tangle the hair.

It is another object of this invention to provide a hair curler with a closure to hold hair on the hair rolling member that may be operated with one hand.

It is also an object of this invention to provide a hair curler with a closure to hold hair on the hair rolling member that is inexpensive.

SUMMARY OF THE INVENTION

The present invention is a hair curler comprising an outer, hollow, cylindrical member with opposed end openings, an inner member within the hollow of the outer member, and a plurality of clips, each clip connected to the inner member by flexible roots and connected to the outer member by an integral pivot axis. The clips extend though longitudinal openings in the outer member. Using finger pressure on the inner member, the inner member may be moved longitudinally relative to the outer member. This movement causes each clip to rotate around its respective pivot axis. Thereby, the clips either grip or release a users hair when the user's hair is wound around the outer member. The present invention also includes detent means that allow the inner member to be restricted in gripping and released positions.

DETAILED DESCRIPTION OF THE INVENTION

Figure 1:
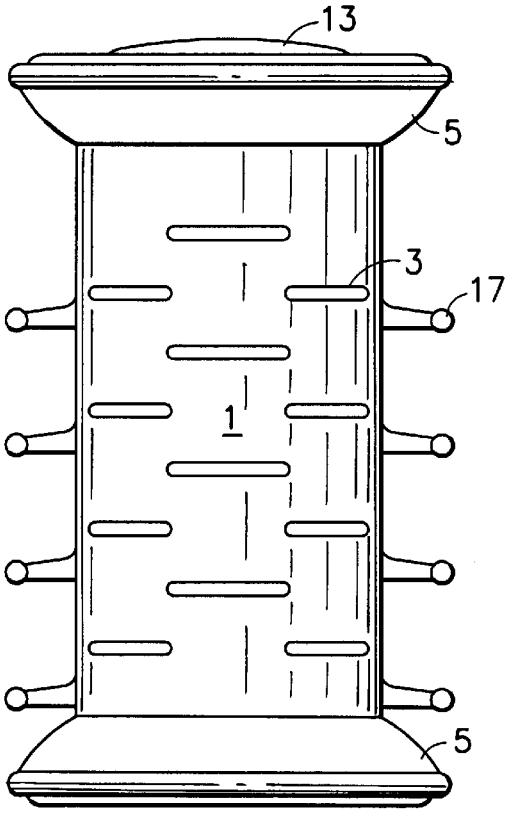
FIG. 1 is an exterior elevational view of a hair curler incorporating the present invention.

FIG. 1 shows an exterior view of a preferred embodiment of a hair curler that incorporates the present invention. Outer member 1 is cylindrical in shape with plural fins 3 on its surface. Outer member 1 also has a pair of end rims 5. A plurality of moveable clips 17 extend outward beyond the surface of outer member 1. One of a pair of end pieces 13 of a moveable inner member 11 (see FIG. 2) can also be seen.

Figure 2:
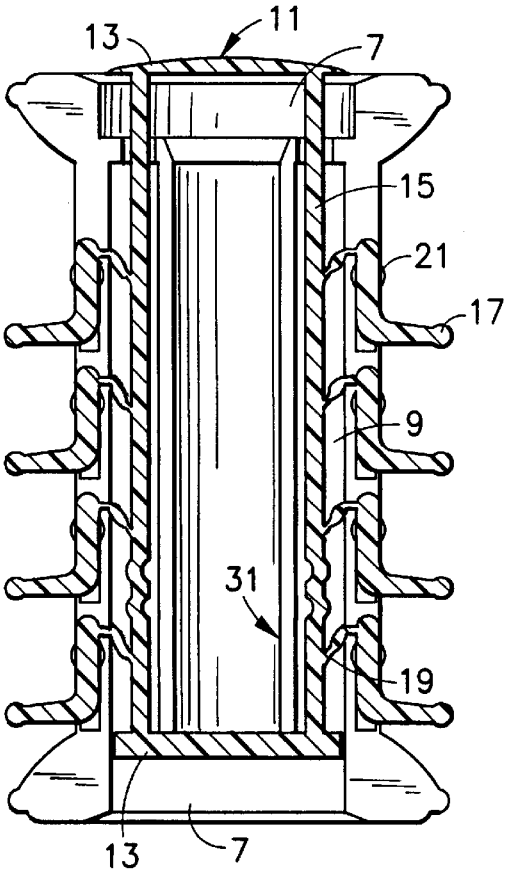
FIG. 2 is a cross sectional view of the hair curler of FIG. 1.

As seen in FIG. 2, outer member 1 has a pair of open ends 7 and a hollow region 9 between the open ends. Inner member 11 is movably positioned within hollow region 9 (see FIG. 4). Inner member 11 comprises a pair of end pieces 13 and two columns 15 connected therebetween, each having plural hair clips 17 attached via roots. The two sets of hair clips 17 preferably extend in opposite directions. Using finger pressure on end pieces 13 of inner member 11, inner member 11 may be moved longitudinally relative to outer member 1.

Figure 3:
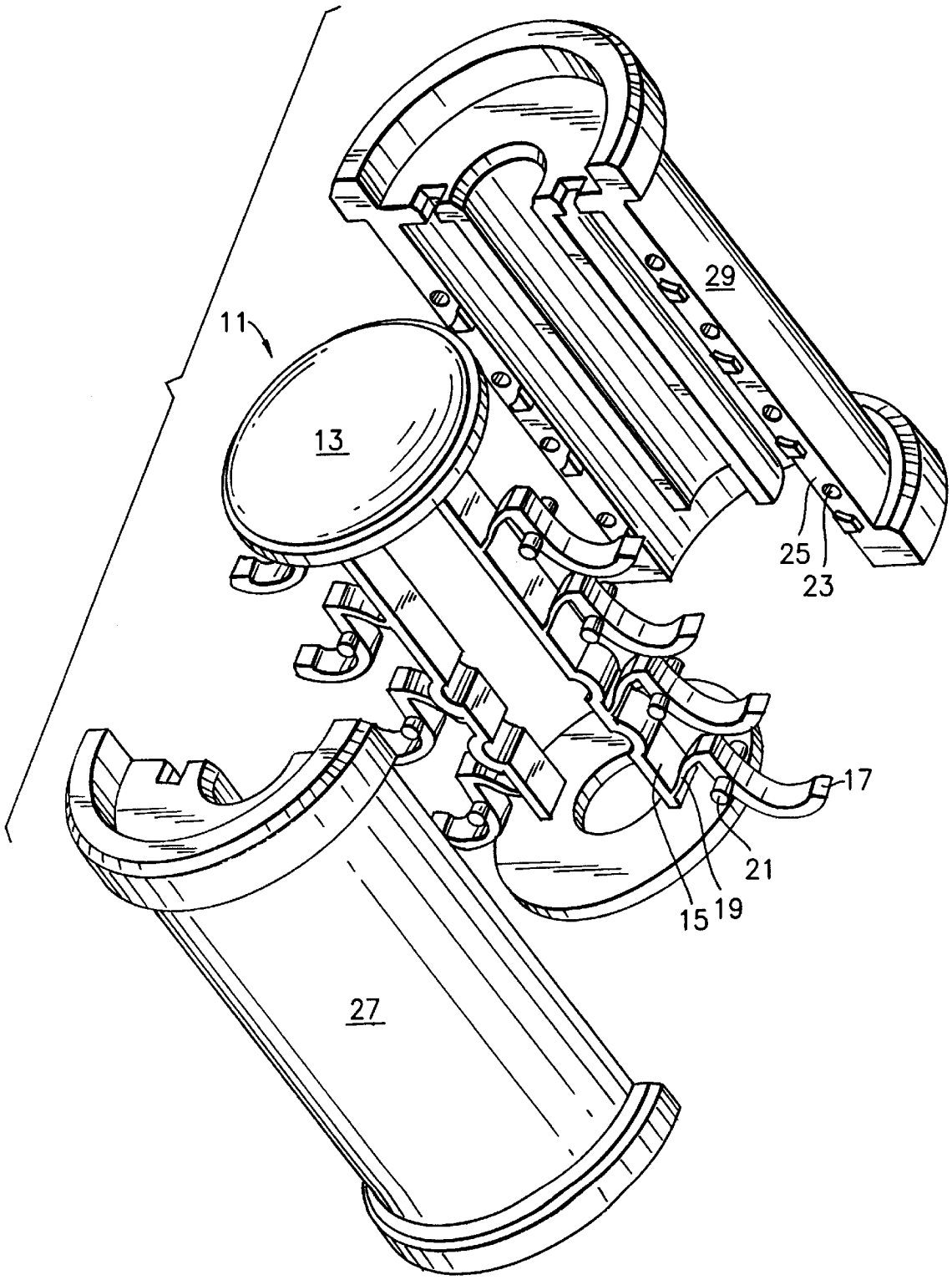
FIG. 3 is an exploded perspective view of the hair curler of FIG. 1.
Figure 4:
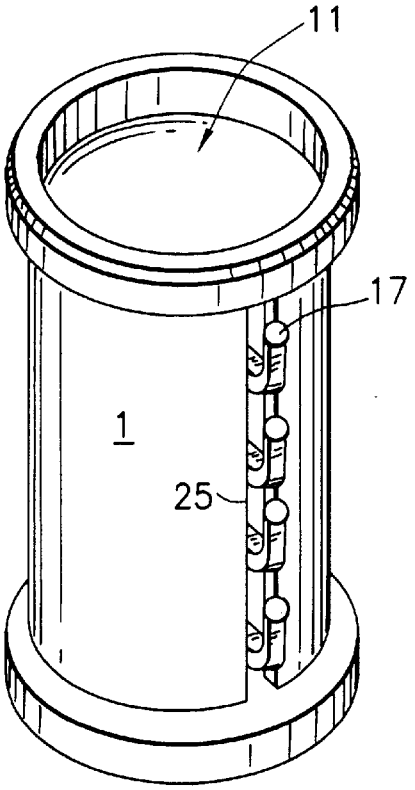
FIG. 4 is an exterior perspective view of the hair curler of FIG. 1 showing the hair clips in the gripping position.
Figure 5:
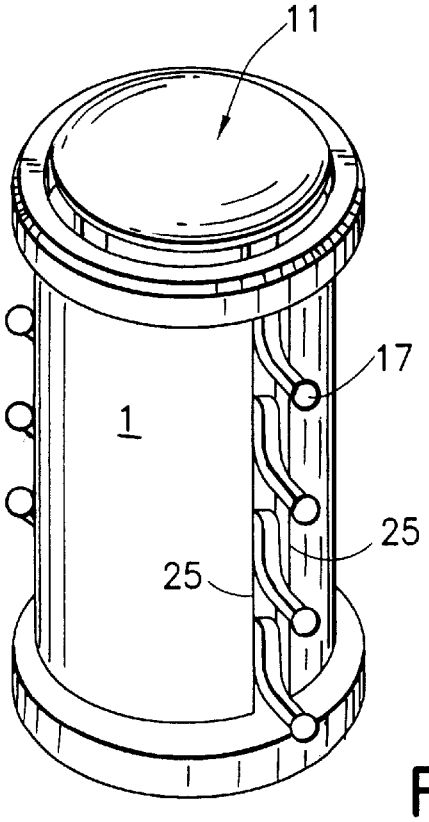
FIG. 5 is an exterior perspective view of the hair curler of FIG. 1 showing the hair clips in the released position.

Each hair clip 17 is connected to inner member 11 via a flexible root 19 and is coupled to outer member 1 via an integral pivot axis 21. FIG. 3 shows that the distal ends of each integral pivot axis 21 fit into an opposed pair of orifices 23. Orifices 23 are formed into edges 25 of semicircular pieces 27 and 29 that comprise outer member 1. Longitudinal movement of inner member 11 relative to outer member 1 causes each hair clip 17 to rotate around its respective pivot axis 21. Thereby, hair clips 17 either grip or release a users hair after the user's hair is wound onto outer member 1 in accordance with the position of inner member 11. The gripping position is shown in FIG. 4, while the released position is shown in FIG. 5.

Figure 6:
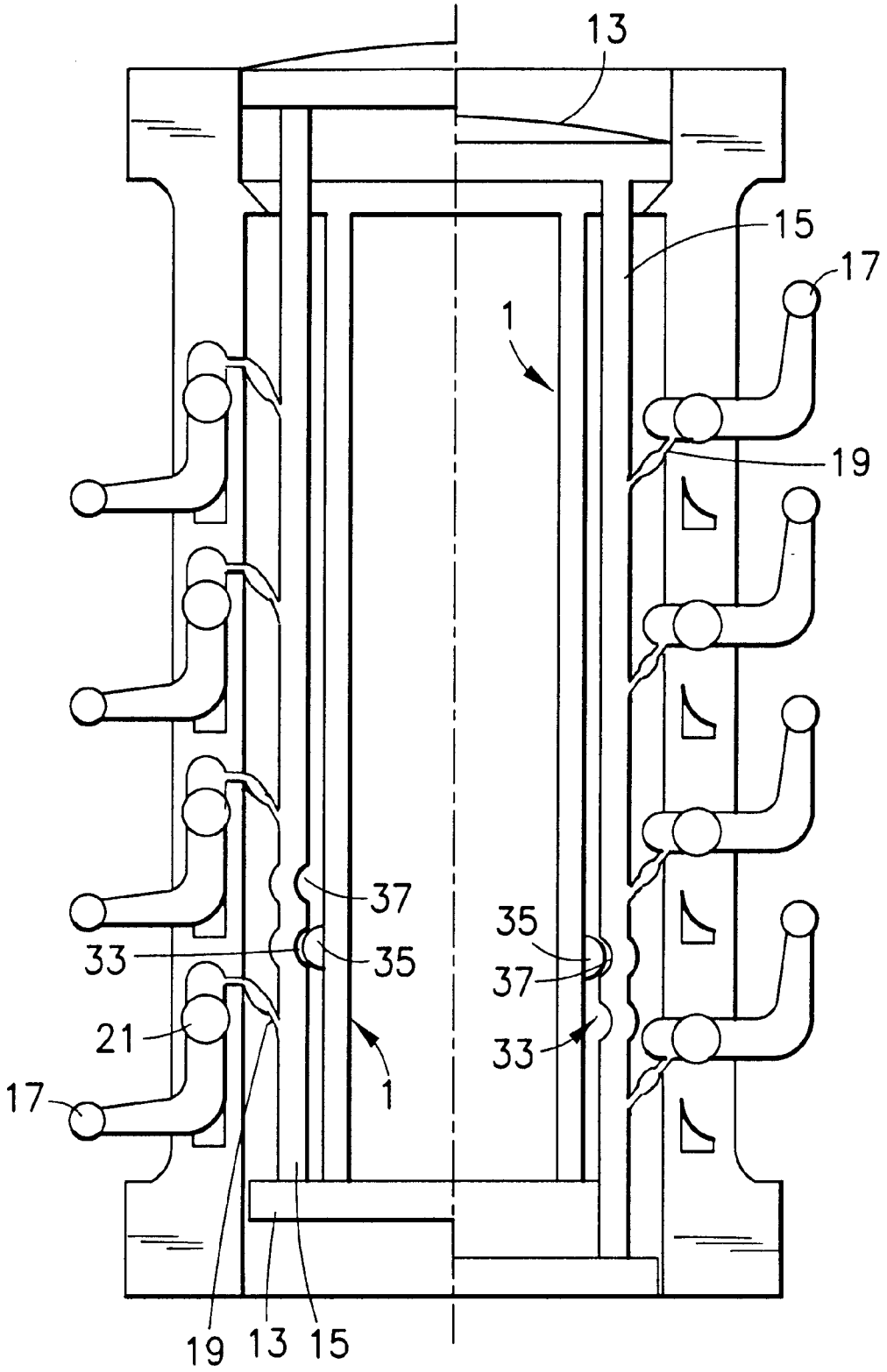
FIG. 6 is a composite sectional plan view of the hair curler of FIG. 1 showing, on the left, hair clips in a released position, and, on the right, hair clips in a gripping position.

In FIG. 6, a detent means 31 are shown that restrict the movement of inner member 11. By restricting the movement of inner member 11, hair clips 17 may be positioned in the released position or the gripping position. The released position is illustrated in FIG. 6 as the unshaded, left side. In the released position, recesses 33 on columns 15 of inner member 11 are engaged by outwardly extending nodules 35 on the interior surface outer member 1. Detent means 31 is in this position when hair is being wound upon outer member 1. The gripping position is illustrated in FIG. 6 as the shaded right side. In the gripping position, recesses 37 on columns 15 of inner member 11 are engaged by outwardly extending nodules 35 on the interior surface of outer member 1.

The exploded view of FIG. 3 also shows how the hair curler can be assembled. Outer member 1 is made of two complementary semi-cylinders 27 and 29. Inner member 11 is molded as a single piece. To assemble, semi-cylinders 27 and 29 are brought together, each pivot axis 21 is inserted into a respective orifice 23 in edges 25 of semi-cylinders 27 and 29, and detent means 31 are mated.

The invention having been thus described with particular reference to the preferred form thereof, it will be obvious that various changes and modifications may be made therein without departing from the spirit and scope of the invention as defined in the appended claims.

What I claim is:

1. A hair curler comprising:

an outer member, said outer member having at least one opening along a length thereof, a pair of open ends, and a hollow region between said open ends;

an inner member within said hollow region, said inner member longitudinally movable therein; and a plurality of clips, each clip having a flexible root connected to said inner member and pivot axis pivotally coupled to said outer member, at least some of said plurality of clips extending through said at least one opening, whereby relative longitudinal movement between said inner member and said outer member causes said plurality of clips to rotate about respectively associated pivot axes in a manner to either grip or release a user's hair.

2. The hair curler as recited in claim 1, wherein said at least one opening has two substantially parallel spaced edges, said edges adapted to receive opposed ends of each said pivot axis of each clip so as to enable rotation thereof.

3. The hair curler as recited in claim 2, wherein said edges include a plurality of opposing orifices, said plurality of opposing orifices adapted to receive opposed ends of each said pivot axis of each clip and to hold said distal ends in place and enable rotation thereof.

4. The hair curler as recited in claim 1, wherein said outer member includes a second opening that extends along said length thereof, with at least some of said clips extending therethrough.

5. The hair curler as recited in claim 1, wherein said inner member comprises:

at least one column, said at least one column connected to said plurality of clips via associated ones of said flexible roots; and a pair of end pieces, said pair of end pieces connected to said at least one column.

6. The hair curler as recited in claim 5, wherein said inner member includes a second column, said columns having respective groups of clips connected thereto.

7. The hair curler as recited in claim 6, wherein said one column and second column are arranged so that respectively connected clips extend in opposite directions through respective ones of said openings.

8. The hair curler as recited in claim 1, wherein said inner member and outer member include cooperating detent means for releasably restraining said relative longitudinal movement therebetween.

9. The hair curler as recited in claim 1, wherein said inner member is longitudinally moveable within said outer member by finger pressure exerted on said inner member, said finger pressure sufficient to overcome the said restraining action exerted by said detent means.

10. The hair curler as recited in claim 1, wherein said outer member is cylindrical in shape and is provided with integral end pieces that are larger in diameter than said outer member.

* * * * *